US008567644B2

(12) United States Patent
Martinez de San Vicente Oliveras

(10) Patent No.: US 8,567,644 B2
(45) Date of Patent: Oct. 29, 2013

(54) PROCEDURE AND SYSTEM FOR DISPENSING DEPILATORY WAX IN A REGULATED MANNER FOR ITS IMMEDIATE APPLICATION

(75) Inventor: Luis Martinez de San Vicente Oliveras, Cornella de Llobregat (ES)

(73) Assignee: Ceras Especiales Martinez de San Vicente, S.A., Cornella de Llobregat (ES)

( * ) Notice: Subject to any disclaimer, the term of this patent is extended or adjusted under 35 U.S.C. 154(b) by 604 days.

(21) Appl. No.: 12/092,912

(22) PCT Filed: Oct. 19, 2006

(86) PCT No.: PCT/EP2006/010076

§ 371 (c)(1),
(2), (4) Date: May 7, 2008

(87) PCT Pub. No.: WO2007/051526

PCT Pub. Date: May 10, 2007

(65) Prior Publication Data

US 2008/0240838 A1 Oct. 2, 2008

(30) Foreign Application Priority Data

Nov. 7, 2005 (ES) ..... 200502698

(51) Int. Cl.
*B67D 7/80* (2010.01)

(52) U.S. Cl.
USPC ..... 222/146.5; 222/80; 222/185.1; 392/447; 432/13; 141/82; 219/214; 219/437; 219/523; 401/1; 401/118

(58) Field of Classification Search
USPC ..... 222/80–91, 146.1, 146.5–146.6, 222/183–184, 185.1, 585–589; 392/441, 392/459, 447–448; 432/13; 141/82; 219/214, 420–421, 432–433, 437, 523; 126/284, 343.5 R; 401/1–3, 118, 120, 401/171–175, 180, 184–185
See application file for complete search history.

(56) References Cited

U.S. PATENT DOCUMENTS

| | | | | | |
|---|---|---|---|---|---|
| 3,103,689 | A | * | 9/1963 | Borisof | 401/2 |
| 3,536,893 | A | * | 10/1970 | Cranley | 219/523 |
| 3,858,985 | A | * | 1/1975 | Fiveash | 401/2 |
| 3,904,086 | A | * | 9/1975 | Losenno | 222/146.5 |
| 3,926,339 | A | * | 12/1975 | Openchowski | 222/83 |
| 3,942,686 | A | * | 3/1976 | Roth | 222/146.5 |
| 4,505,669 | A | * | 3/1985 | Rogers | 432/13 |
| 4,646,944 | A | * | 3/1987 | Sanderson | 222/108 |
| 5,274,736 | A | * | 12/1993 | Rohr, Jr. | 392/447 |

(Continued)

FOREIGN PATENT DOCUMENTS

GB 2 334 014 A 8/1999

*Primary Examiner* — Paul R Durand
*Assistant Examiner* — Andrew P Bainbridge
(74) *Attorney, Agent, or Firm* — Sughrue Mion, PLLC

(57) ABSTRACT

A melted depilatory wax dispenser has a container with an opening that stores solid depilatory wax at room temperature. The container is opened, inverted and inserted into a vertically protruding heating element and the opening is placed upon and sealed to an adaptor ring. As the heating element heats the contents of the container, the wax melts and is dispensed through a mouth which leads to a piping system and a valve which in turn leads to a dispensing tube which allows the hot wax to be dispensed in a controlled and easy fashion.

23 Claims, 3 Drawing Sheets

(56) References Cited

U.S. PATENT DOCUMENTS 5,324,305 A * 6/1994 Kanner ..... 606/213
5,405,058 A * 4/1995 Kalis et al. ..... 222/185.1
5,680,961 A * 10/1997 Boccagno et al. ..... 222/143
6,053,649 A 4/2000 Ronai
6,935,535 B2 * 8/2005 Pandolfi et al. ..... 222/146.5
7,237,582 B1 * 7/2007 Harvey ..... 141/330
2004/0200541 A1 * 10/2004 Pandolfi et al. ..... 141/82

* cited by examiner

PROCEDURE AND SYSTEM FOR DISPENSING DEPILATORY WAX IN A REGULATED MANNER FOR ITS IMMEDIATE APPLICATION

FIELD OF THE INVENTION

The invention relates to a procedure and system for dispensing depilatory wax in a regulated manner for its immediate application, and more particularly for successively supplying several refillable tanks of wax applicators in a clean and safe manner.

BACKGROUND OF THE INVENTION

The melted wax applicators for hair removal that are currently known generally consist of a hand-holdable casing with a top opening, inside which is housed a container for depilatory wax to be applied to a user's skin in very fine films with the aid of an applicator roller, which is positioned over the mouth of the container, in the opening of the casing.

The wax container can consist of a heatable tank that is solidly joined to the casing, which must be refilled with new wax as the stored wax is applied to a user's skin. However, applicators that include this type of tanks are not very widely used, as the operation of refilling said tanks presents several problems.

Firstly, applicators of this type store and dispense warm wax, which flows when its temperature exceeds approximately 36° C., but the state of which at room temperature is too viscous to be poured from one recipient to another. For this reason, the wax must be heated before it is poured into the applicator tanks, meaning that it is necessary to have suitable heaters to heat the wax.

Secondly, the capacity of the applicator tanks is not very large, meaning that the quantity of wax that must be heated to fill the tank of a single applicator is also very small. Having to heat very small quantities of wax several times represents a significant waste of time and energy efficiency. Heating large quantities of wax to supply more than one tank at a time increases the energy efficiency of the operation, but it is only advantageous if several applicators are soon to be used for hair removal.

Thirdly, particularly during the operation of pouring the melted wax from the recipient that contains it into the applicator tanks, the wax must be handled with great care as any melted wax that spills out of the mouth of the tanks solidifies as it cools and soils the components of the applicators, such as the rotating application rollers, subsequently preventing these from functioning correctly.

For these reasons, it is more common to use applicators in which the wax is stored in single-use containers in the form of cartridges, which can be replaced by other full containers when the stored wax runs out. These cartridges allow users to replace the wax in a container once said wax has run out, changing the whole container or cartridge without soiling or coming into direct contact with the wax.

Although this system is, a priori, much cleaner than the system disclosed above, wherein the wax tanks are not replaceable and must be successively refilled with wax, it also presents certain drawbacks. These include the price of the empty containers or cartridges, which significantly affects the price of the container full of wax, the form in which it is sold. This particularly affects wax manufacturers, who have to supply the product in containers or cartridges that are suitably adapted to be inserted into the applicators.

For this purpose, the containers must be sufficiently rigid and must be capable of supporting the heat that is needed to heat the wax for the application thereof. In addition to the high cost of the containers, storing and transporting wax in small quantities in its respective containers also increases the price of the transport and storage operations per unit of wax.

Furthermore, the stored wax content of the cartridges is not totally usable, as a certain wastage of wax always remains stuck to the base and inner walls of the cartridges.

For all these reasons, it is particularly interesting to achieve an optimum procedure and system for dispensing wax in a controlled manner that are adapted for refilling the fixed tanks of the applicators cleanly and easily, which does not require the use of said replaceable containers or cartridges.

Document US 2004/0200541 discloses a wax dispenser that comprises tanks containing wax electrically heated by electrical resistances. This device is particularly designed for storing sufficient quantities of melted depilatory wax, of the hot wax type, to supply several containers for hair removal applications on more than one user.

The heat applied to the tanks is transmitted, by conduction, to the wax stored therein, so that it melts and becomes more fluid. A circuit connects a mouth in the base of the tanks to a corresponding valve element that allows the controlled dispensation of the desired quantity of melted hot wax. Although the device allows the controlled dispensation of wax, it does not solve some of the aforementioned problems. Specifically, although the device makes it possible to dispense wax stored in its tanks, it does not solve the problem of how to first put the wax into said tanks.

Moreover, the electrical resistances are positioned in such a way that they only directly heat a small portion of one of the side walls of the tanks, through which the heat is transmitted to the wax, therefore requiring a high energy consumption. The energy loss is also very high, as the resistances consume the same amount of energy regardless of the amount of wax stored in the tanks. It is obvious that when the tanks are practically empty, according to the device disclosed in US 2004/0200541 it would be necessary to provide less heat to melt the wax, which is not provided for according to the description of said document.

EXPLANATION OF THE INVENTION

The procedure for dispensing depilatory wax, in a regulated manner for its immediate use, that is the object of the invention is essentially characterised in that it comprises the steps of positioning a container of depilatory wax in an inverted position, with at least one outlet opening for the wax, in such a way that said outlet opening is in the lowest part of the container; heating, directly inside the container, the wax in the lowest part of the container close to the outlet opening thereof, at a temperature that is higher than that at which the wax melts so that the wax, by gravity, flows out of the container through the outlet; and regulating the quantity of wax to be dispensed.

According to another characteristic of the invention, the step of heating the wax in the area around to the outlet opening of the container is performed by inserting into the depilatory wax a heating element that passes through the outlet opening of the container.

Another object of the invention is a system for the regulated dispensation of melted depilatory wax, in a melted state that is suitable for its application on a user's skin, which is essentially characterised in that it comprises a container which stores wax at room temperature in a practically solid state, with at least one outlet opening, the mouth of which is adapted for the melted wax to pass therethrough; and a dispenser device comprising a means of attachment of the container, which is adapted to receive the mouth of at least one container; at least one valve element that is suitable for dispensing viscous products; a means of piping the melted wax from the mouth of the plugged-in container to the entrance to the corresponding valve element; and a heating means provided in said means of attachment.

According to another characteristic of the system, the means of attachment disposed in the dispenser device comprises a receptacle with an outer opening that is adapted to receive and house the mouth of the plugged-in container, and the heating means is disposed in said cavity, extending outward beyond its outer opening.

According to another characteristic of the invention, the heating means is disposed essentially perpendicular to the plane of opening of the means of attachment and is adapted to be inserted into the container when the latter is plugged into said means of attachment.

According to a preferred embodiment, the heating means consists of a rod with a plurality of radially disposed flanges to increase the contact surface with the wax.

According to another variant of the system of the invention, said receptacle comprises a tubular upper portion with an inner seating and the means of attachment also comprises an elastic means that rests on the seating of the tubular portion of the receptacle, on which an adjusting ring rests to receive the support of the mouth of the container, it being possible for said ring to rest on said inner seating, fitting tightly, as the opening of the container rests thereon, exerting sufficient pressure to compress the elastic means on which said ring rests, thus allowing the melted wax to flow towards the base of the receptacle and through the central hole of the adjusting ring.

According to another variant of the invention, the means of attachment also comprises a sealing joint consisting of a deformable ring that rests on the seating of the tubular portion of the receptacle, upon which the adjusting ring rests under pressure when the elastic means is compressed.

According to another characteristic of the invention, the dispenser device has a perforating means that is adapted to provide the container plugged into the dispenser device with at least one ventilation hole.

In a preferred embodiment, the perforating means is disposed on a rotating body that is articulatedly joined to the dispenser device and can be moved from a receiving position A to an operational position B and vice versa, and the height of the container is adapted so that when the rotating body is in its receiving position and the opening of the container is resting on the adjusting ring, as the rotating body moves to its operational position, it exerts pressure on the base of the container and perforates it, and the container moves downwards, dragging the adjusting ring with it, thereby compressing the elastic means and ensuring that the adjusting ring rests on the seating of the tubular portion of the receptacle of the means of attachment.

According to a variant of the system, the entrance to one of the valve elements is situated at a higher level than that of the corresponding means of attachment of the dispenser device to which it is connected, and the dispenser device has a pump to propel the melted wax from the area around the means of attachment to said entrance to the valve elements.

According to another variant of the invention, the entrance to one of the valve elements is situated at a lower level than that of the corresponding means of attachment of the dispenser device to which it is connected.

According to another characteristic of the system of the invention, the dispenser device has a collector tray that is adapted to collect any melted wax that spills out of the valve element and to pour it into the receptacle of the means of attachment through its outer opening.

BRIEF DESCRIPTION OF THE DRAWINGS

Different embodiments of a system for performing the method of the invention are illustrated in the attached drawings by way of a non-limiting example. In said drawings.

DETAILED DESCRIPTION OF THE DRAWINGS

Figure 1:
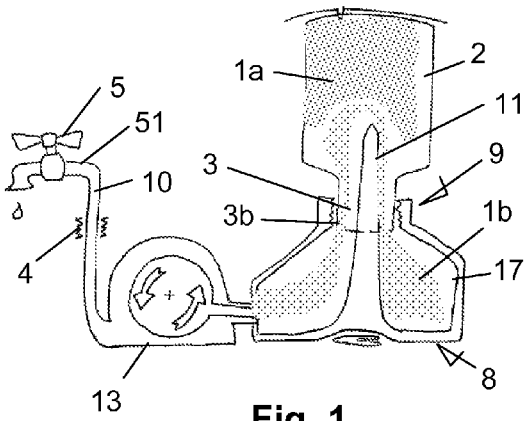
FIG. 1 is a schematic drawing of one variant of the system that is the object of the invention.
Figure 2:
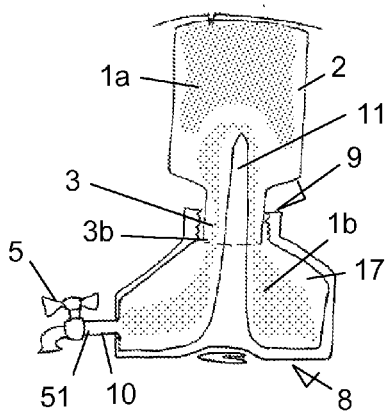
FIG. 2 is a schematic drawing of another variant of the system of the invention.

FIGS. 1 and 2 schematically show two variants of a system that makes it possible to perform a procedure for dispensing depilatory wax in a regulated manner. Said procedure makes it possible to dispense depilatory wax for its immediate application, sufficiently fluidised and hot, using wax that was originally stored in a container at room temperature and in a state that was too viscous to be poured or applied directly to a user's skin, all of which avoids the need for direct contact with the wax, the need to pour the wax from one container to another or to heat the wax container to fluidise said wax.

The system shown in FIGS. 1 and 2 consists of a container 2 for wax 1*a*, with an outlet opening 3 for the stored wax, and a dispenser device 8 comprising a means of attachment 9 that is adapted to receive the mouth 3*b* of the outlet opening 3 of the container 2. This means of attachment has a heating means 11 that is adapted to be inserted into the container 2 when it is plugged into the means of attachment 9 of the dispenser device 8.

As is shown in FIGS. 1 and 2, the container 2 is attached to the dispenser device 8 in an inverted position, in such a way that the wax in the container 2, which melts and fluidises as a result of the heat supplied by the heating means 11, falls due to gravity and flows out of the container 2 through the mouth 3*b* of the outlet 3. The space inside the container 2 that was occupied by the melted wax 1*b* that flows out of said container 2 is gradually occupied by wax 1*a* that is still in a viscous state in the container 2, which then occupies the space around the heating means 11, causing it to fluidise and flow out of said container 2, and this occurs successively until the container 2 is completely empty.

The melted wax 1*b* that flows out of the container 2 is collected in a receptacle 17 with which the means of attachment 9 is provided, from which it is taken through a piping means 10 to a valve element 5 that can be actuated by a user, by means of which it is dispensed in a regulated manner from the dispenser device 8.

In the example shown in FIG. 1, the valve element 5 is disposed at a higher level than the base of the receptacle 17, for which the dispenser device 8 also has a pump 13 to propel the melted wax 1*b* from the receptacle 17 to the entrance to the valve element 5. In this case the piping means 10 will be heated in order to maintain the melted wax 1*b* in optimum conditions for its subsequent dispensation and use. FIG. 1 shows a set of electrical resistances 4 to illustrate said characteristic.

However, in the example shown in FIG. 2, the valve element 5 is disposed at a lower level than the base of the receptacle 17, therefore not requiring a pump to propel the melted wax 1*b*, which can be dispensed, due to gravity, through the valve element 5 that is connected directly to the receptacle 17.

The dispenser device 8 is adapted, as will be explained below, to support a depilatory wax applicator 31 (see FIG. 7) in a stable position, in such a way that the mouth of the tank of said applicator is disposed immediately below the outlet of the valve element 5, meaning that it can be refilled with the melted wax 1*b* that was originally stored in the container 2.

The containers 2 in which the wax is stored should have a capacity of about four litres, meaning that one container 2 can refill several conventional applicator tanks.

Figure 3:
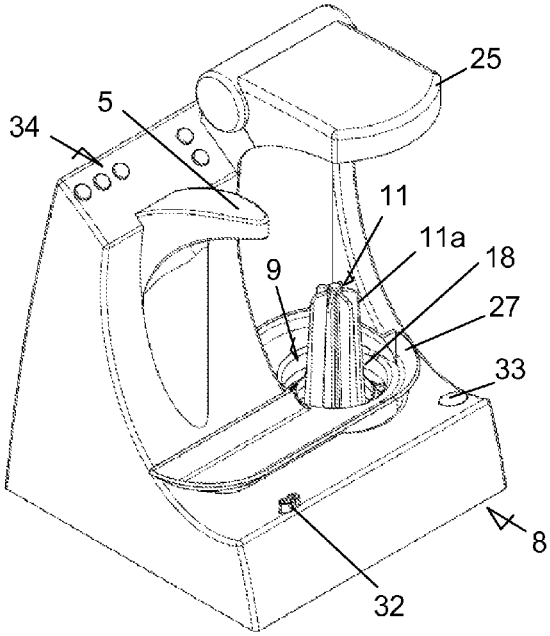
FIG. 3 is a perspective view of a dispenser device and a container according to the variant shown in FIG. 1 of the system of the invention.
Figure 3:
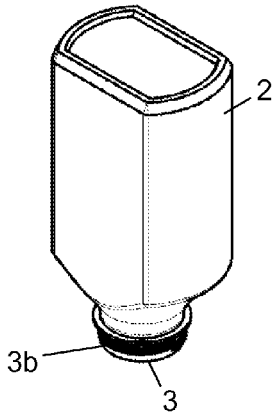

FIG. 3 shows a perspective view of a dispenser device 8 and a container 2 that can be attached to one another, according to a variant of the system schematically shown in FIG. 1. In said FIG. 3 it is possible to observe the above-described elements of the device and, specifically, the outer opening 18 of the receptacle of the means of attachment 9, which will receive and house the mouth 3*b* of the wax outlet 3 of the container 2, the heating means 11 and the valve element 5.

As regards the heating means 11, in the example shown in FIG. 3 it extends perpendicular to the plane of the outer opening 18 of the means of attachment 9, and consists of a rod with a plurality of radially disposed flanges 11*a*, the purpose of which is to increase the contact surface with the wax inside the container once it is plugged into the dispenser device 8.

It can be observed in FIG. 3 that the valve element 5 is disposed laterally in the dispenser device 8, so that it does not obstruct the operations of attaching and detaching the container 2 to and from said dispenser device 8. A means of support 32 can be seen on the lower part of said dispenser device 8, which is suitable for firmly holding a wax applicator (not shown) and for supplying it with an electric current.

The dispenser device 8 also comprises a collector tray 27, for collecting any melted wax 1*b* that might spill out of the valve element 5 when the wax applicator (see FIG. 7) is not in its filling position. The collector tray 27 is slightly inclined towards the outer opening 18 of the means of attachment 9 and extends from the area disposed below the outlet of the valve element 5 to said outer opening 18, which it overhangs in order to pour into it the melted wax 1*b* that it collects and channels. Although the valve element 5 has an anti-drip device, on closing off the flow of melted wax 1*b*, and due to its viscosity, a certain amount of the product can remain stuck to the outlet of the valve element 5, which can be removed from said valve element once the applicator 31 has been removed from its filling position. When this occurs, the collector tray 27 prevents the melted wax 1*b* removed from the valve element 5 from soiling the dispenser device 8.

The device shown in FIG. 3 also has a rotating body 25, the purpose of which, as will be explain below, is to perforate the base of the container 2 in order to allow air to enter it as said container 2 empties, and to ensure a correct attachment between the container 2 and the dispenser device 8.

Figure 4A:
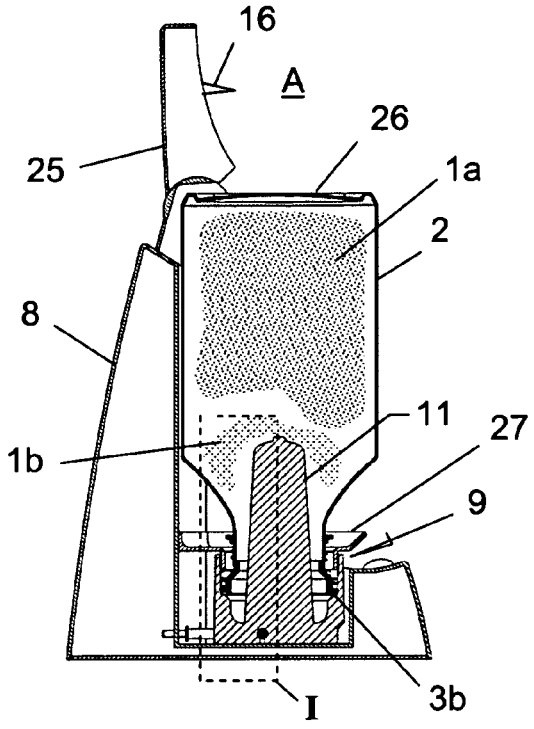
FIGS. 4*a* and 4*b* are sectional views of the dispenser device and the container shown in FIG. 3, in a plugged-in position and in an operational position, respectively.

To attach the container 2 to the dispenser device 8, the procedure is as follows:

First, the rotating body 25 is positioned in the receiving position A, as shown in FIG. 4*a*, and the container 2 (the seal having been removed from its opening 3, should this be the case) is inverted, inserting its mouth 3*b* into the receptacle 17 through its outer opening 18 until it is resting inside said receptacle. The rotating body 25 is then actuated, rotating it towards the position shown in FIG. 4*b*, thus causing the base 26 of the container 2 to be perforated as it is punctured by a perforating means 16 disposed for this purpose on the underside of the rotating body 25. Said puncturing operation provides the container 2 plugged into the dispenser device 8 with at least one ventilation hole through which air can penetrate into said container as it empties.

Figure 4B:
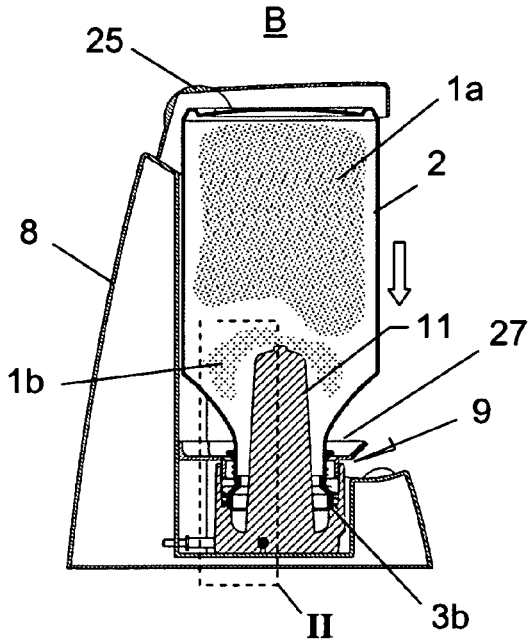

As the rotating body 25 moves from the receiving position A into the operational position B, as shown in FIG. 4*b*, said rotating body 25 exerts pressure on the base 26 of the container 2, moving it in the direction shown by the arrow in FIG. 4*b* and ensuring a tight attachment between the mouth 3*b* of the container 2 and the dispenser device 8.

Figure 5A:
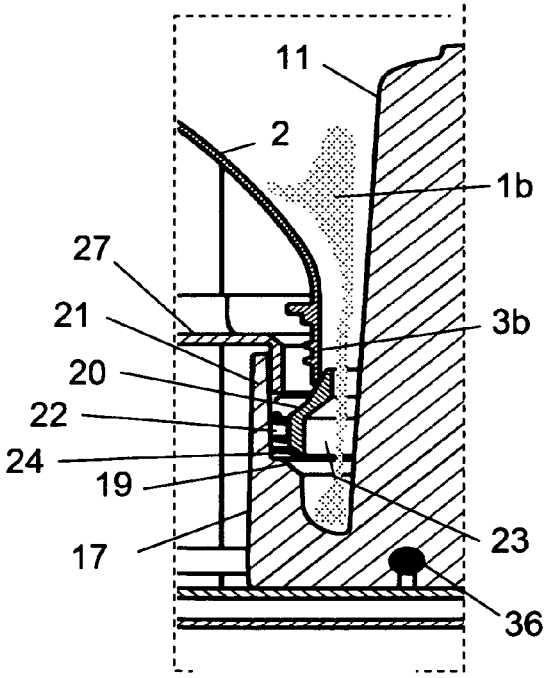
FIGS. 5*a* and 5*b* are detailed views of areas I and II of FIGS. 4*a* and 4*b*, respectively.
Figure 5B:
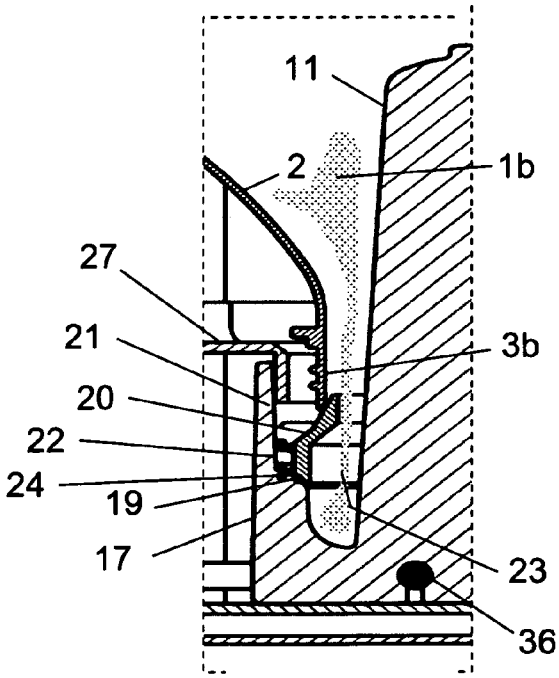

FIGS. 5*a* and 5*b* are detailed sectional drawings of areas I and II of FIGS. 4*a* and 4*b*, respectively. In said FIGS. 5*a* and 5*b* it is possible to observe that the receptacle 17 of the means of attachment 9 of the dispenser device 8 comprises a tubular upper portion 21 with an inner seating 19 on which rest a sealing joint 24, consisting of a deformable plastic ring, and an elastic means, consisting of a compression spring 22. An adjusting ring 20 rests on said spring 22, configured on its upper side to receive the mouth 3*b* of the container 2 and on its lower side in such a way that its lower edge 29 (see FIG. 6) can rest, under pressure, against the sealing joint 24.

It can also be observed that the receptacle 17 and the heating means 11 consist of a single body, preferably made of a metal material, and that the heat source of the heating means 11 is disposed at the base of the rod that extends outward from said receptacle 17, said heat source consisting of a circular PTC type thermistor 36. The storage capacity of the receptacle 17 must be sufficient to supply the tank of at least one wax applicator 31 when all the wax has been extracted from the plugged-in container 2.

The above-described assembly is adapted in such a way that the adjusting ring 20 does not rest on the sealing joint 24 if the latter is not pushed down. FIG. 5*a* effectively shows that when the rotating body 25 is not in the operational position B, the adjusting ring 20 is not in contact with the sealing joint 24, whilst in FIG. 5*b* it can be seen that the container 2 has moved downward, in turn pushing down on the adjusting ring 20 and compressing the spring 22, whereby said adjusting ring 20 rests on said sealing joint 24. When this occurs, the melted wax 1*b* can only pass through the central hole 23 of said adjusting ring 20 towards the base of the receptacle 17.

When the adjusting ring is in the position shown in FIG. 5*a*, the wax from the collector tray 27 can pass between said adjusting ring 20 and the inner seating 19, thereby flowing into the receptacle 17. It is therefore not necessary for the overhang of the collector tray 27 to extend as far as the central area of the outer opening 18 of the receptacle 17 in order to pour the melted wax 1*b* into the receptacle 17 through the central hole 23 of the adjusting ring 20, which would undoubtedly make it more difficult to plug the container 2 into the means of attachment 9.

Figure 6:
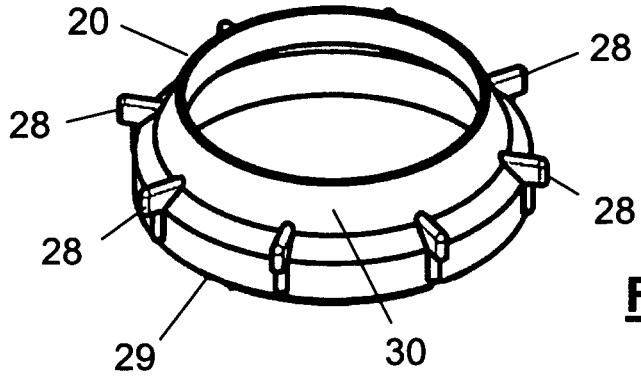
FIG. 6 is a perspective view of the adjusting ring of the means of attachment of the dispenser device shown in FIGS. 4*a*, 4*b*, 5*a* and 5*b*.

FIG. 6 shows a detailed drawing of an embodiment of the adjusting ring 20. In said FIG. 6 it can be observed that the upper half of the adjusting ring 20 has a truncated coneshaped portion 30 for receiving the mouth 3*b* of the container 2. The intermediate portion of the adjusting ring 20 has a plurality of projections 28, regularly disposed around its outer profile, by means of which the adjusting ring 20 rests and presses on the spring 22 as it moves downward.

Figure 7:
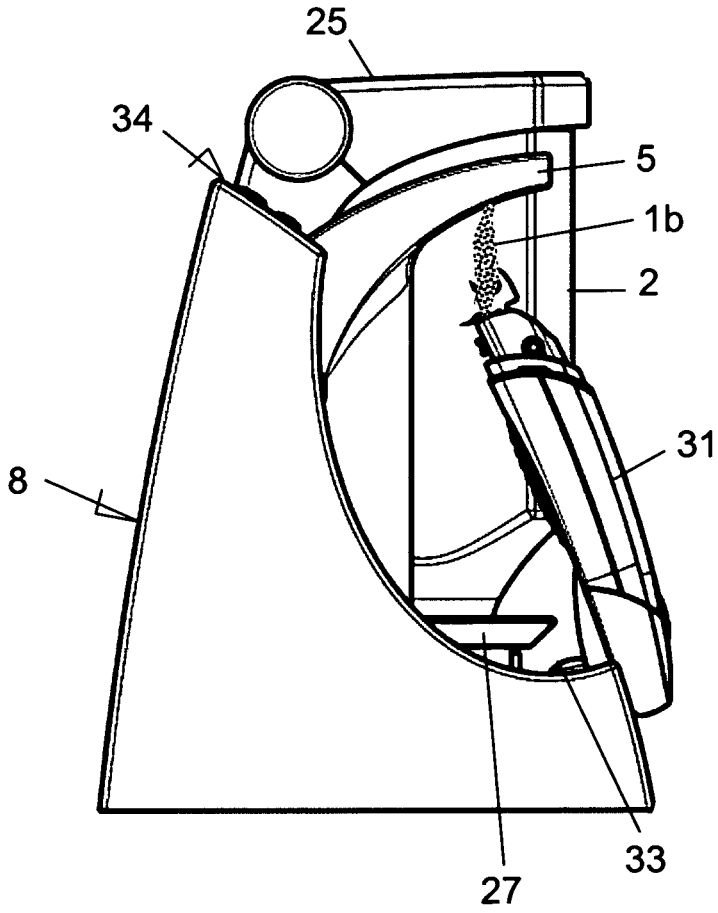
FIG. 7 is a perspective view of the dispenser device and the container shown in FIG. 3, both plugged in and in an operational position, during the wax dispensing operation for filling the tank of a wax applicator device.

FIG. 7 shows the container 2 and the dispenser device 8 of FIG. 3 in operation, i.e. with the container 2 plugged into the dispenser device 8 and the rotating body 25 in the operational position B. In said FIG. 7 it can be observed that the valve element 5 is dispensing melted wax 1*b*, which falls into a wax applicator 31 to fill its tank.

Advantageously, it is anticipated that the container 2 of the system according to the invention should be at least partially transparent, so that its content is visible from the outside and the quantity of wax that remains therein is known at all times. It is also particularly interesting for the collector tray 27 to be made of a metal material such as aluminium, which is a good heat conductor, so that the melted wax 1*b* that it collects remains in the most fluid state possible. Although not shown here, it is anticipated that the collector tray 27 should have a number of inflections to serve as supports for wax applicator rollers, of the type used in wax applicators for applying a film of wax to a user's skin, in order to keep them at an optimum working temperature.

The procedure of the invention and the system for putting it into practice make it possible to store manufactured depilatory wax in bulk, putting it into large containers 2, which reduces the subsequent storage and distribution costs for the volume of product. The containers 2 are disposable, as they are perforated during the operation of emptying the dispenser device 8, and their cost is inexpensive because they are not required to comply with any particular specifications in terms of having to support high temperatures, as the containers 2 are not directly heated.

For the correct operation of the dispenser device 8 shown in FIGS. 3 and 7, it has a control module (not shown) that comprises an electric switch that controls the heating means 11 and/or the pump 13. For safety reasons, if the container 2 is not correctly plugged into the dispenser device 8, i.e. if the adjusting ring 20 is not in contact, under pressure, with the sealing joint 24, the thermistor 36 remains switched off and does not emit heat, meaning that the wax in the container 2 will not melt and will not be extracted from said container.

Furthermore, the dispenser device 8 has a number of indicator pilot lights 34 and a push button 33 that actuates the valve element 5 and the pump 13 to dispense the melted wax 1*b*. If the wax contained in the receptacle 17 or in the piping means 10 is not sufficiently hot, a pilot light comes on in a colour indicating that the dispenser device 8 is waiting for the wax to reach the correct temperature and the pump 13 remains off. Whilst this occurs, an electric current is made to flow through the resistances 4 (which can also consist of PTC thermistors), which heat the melted wax 1*b*, thus increasing its temperature. When a temperature sensor detects that it has reached a sufficient value, another pilot light comes on in a different colour to the first, indicating that the wax is sufficiently heated, and while the push button 33 is held down, the pump 13 will propel the melted wax 1*b* towards the valve element 5, through which the melted wax 1*b* will be dispensed from the device.

The invention claimed is:

1. A system for the regulated dispensation of melted depilatory wax, in a melted state that is suitable for application on a user's skin, comprising:

a container containing wax at room temperature in a practically solid state, the container comprising a container body with at least one outlet opening, a mouth adapted for the melted wax to pass therethrough; and a dispenser device comprising attachment means for attaching the container to the dispenser device and for receiving the mouth of the container to allow the flow of melted wax therethrough, the attachment means comprising an outer opening of a receptacle to which the container is connected;

a valve element that is suitable for dispensing viscous products;

piping that conveys the melted wax from the mouth of the container to an entrance of the valve element; and heating means for heating the wax contained in the container, the heating means disposed in the receptacle and extending upward through the outer opening of the receptacle and the outlet opening of the container into the container body; wherein the container is disposed in an inverted orientation;

wherein said receptacle comprises a tubular upper portion with an inner seating, the attachment means further comprises an elastic means that rests on the seating of the tubular portion of the receptacle, on which an adjustment ring rests to receive the support of the mouth of the container, and said adjustment ring rests on said inner seating, fitting tightly, as the mouth of the container rests thereon, exerting sufficient pressure to compress the elastic means on which said ring rests, thus allowing the melted wax to flow towards the base of the receptacle and through the central hole of the adjustment ring.

2. System according to claim 1, wherein the heating means is disposed substantially perpendicular to a plane of the outer opening of the attachment means and is adapted to be inserted into the container when the container is plugged into said attachment means.

3. The system according to claim 1, wherein the heating means comprises a rod with a plurality of radially disposed flanges to increase the contact surface with the wax.

4. The system according to claim 1, wherein the attachment means further comprises a sealing joint comprising a deformable ring that rests on the seating of the tubular portion of the receptacle, upon which the adjustment ring rests under pressure when the elastic means is compressed.

5. The system according to claim 1, wherein the dispenser device has a perforating means that is adapted to provide the container plugged into the dispenser device with at least one ventilation hole.

6. The system according to claim 5, wherein:

the perforating means is disposed on a rotating body that is joined in an articulated manner to the dispenser device and can be moved from a receiving position A to an operational position B and vice versa, the height of the container is adapted so that when the rotating body is in the receiving position and the mouth of the container is resting on the adjusting ring, as the rotating body moves to the operational position, the rotating body exerts pressure on the base of the container and perforates the base of the container, and the container moves downwards, dragging the adjusting ring with it, thereby compressing the elastic means and ensuring that the adjusting ring rests against the seating of the tubular portion of the receptacle of the attachment means.

7. The system according to claim 1, wherein the entrance of the valve element is situated at a higher level than a level of the attachment means of the dispenser device, and the dispenser device has a pump which is disposed in communication with and between the receptacle and the valve element and propels the melted wax from the area around the attachment means to said entrance of the valve element via the piping.

8. The system according to claim 1, wherein the entrance to the valve element is situated at a lower level than a level of the attachment means of the dispenser device.

9. The system according to claim 1, wherein the dispenser device has a collector tray that is adapted to collect melted wax that spills out of the valve element and to automatically channel the spilled wax into the receptacle of the attachment means through the outer opening.

10. The system according to claim 1, comprising more than one attachment means for attaching more than one container to the dispenser device and more than one valve for dispensing viscous products.

11. The system according to claim 1, wherein the container is a disposable container and replaced with a new disposable container each time the wax in the container is used up.

12. The system according to claim 1, further comprising a piercing element that pierces the bottom of the container to allow air into the container as the wax flows out of the container.

13. A system for the regulated dispensation of melted depilatory wax in a melted state that for application on a user's skin, comprising:

a container containing depilatory wax at room temperature in a substantially solid state, the container comprising a container body and a mouth defining an outlet opening through which melted wax passes;

a dispenser device comprising a receptacle with an outer opening to which the container mouth is connected, and a coupling to which the mouth of the container is releasable attached so that, when connected, melted wax passes from the mouth of the container to the receptacle;

a valve structured to dispense viscous products;

piping that conveys the melted wax from the receptacle to the valve; and a heating element that extends vertically from the coupling and through the outer opening of the receptacle and the outlet opening of the mouth and into the container body when the container is attached in an inverted orientation so as to melt the wax within the container and cause the melted wax to flow downward around the heating element and into the receptacle;

wherein the coupling comprises an adjusting ring configured at an upper end of the adjusting ring to receive the mouth of the container, the adjusting ring resting on a spring biasing the adjusting ring away from engagement with a sealing joint.

14. The system according to claim 13, wherein:

an entrance of the valve is disposed higher than the receptacle, and the dispenser device further comprises a pump which is disposed in communication with and between the receptacle and the valve via the piping.

15. The system according to claim 14, further comprising: another heating element which is disposed around the piping.

16. The system according to claim 15, wherein the another heating element is disposed between the pump and the entrance of the valve.

17. The system according to claim 14, wherein the valve and the pump are disposed laterally with respect to the receptacle.

18. The system according to claim 13, wherein the outer opening narrows proximate the outlet opening .

19. The system according to claim 13, wherein the container is a disposable container and replaced with a new disposable container each time the wax in the container is used up.

20. The system according to claim 13, further comprising a piercing element that pierces the bottom of the container to allow air into the container as the wax flows out of the container.

21. The system according to claim 13, wherein the container narrows from the body to the mouth.

22. The system according to claim 13, wherein the adjusting ring comprises radial projections engaging the spring.

23. A system for the regulated dispensation of melted depilatory wax, in a melted state that is suitable for application on a user's skin, comprising:

a container containing wax at room temperature in a practically solid state, the container comprising a container body with at least one outlet opening, a mouth adapted for the melted wax to pass therethrough; and a dispenser device comprising attachment means for attaching the container to the dispenser device and for receiving the mouth of the container to allow the flow of melted wax therethrough, the attachment means comprising an outer opening of a receptacle to which the container is connected;

a valve element that is suitable for dispensing viscous products;

piping that conveys the melted wax from the mouth of the container to an entrance of the valve element; and heating means for heating the wax contained in the container, the heating means disposed in the receptacle and extending upward through the outer opening of the receptacle and the outlet opening of the container into the container body; wherein the container is disposed in an inverted orientation; and wherein the dispenser device has a collector tray adapted to collect melted wax that spills out of the valve element and to automatically channel the spilled wax into the receptacle through the outer opening.

* * * * *